US006479909B1

(12) United States Patent
Hamm et al.

(10) Patent No.: US 6,479,909 B1
(45) Date of Patent: Nov. 12, 2002

(54) CLOSURE ELECTRIFIER WITH A LOW MASS TRANSFORMER

(75) Inventors: Valery Hamm, La Fleche (FR); Yves Mulet-Marquis, La Meignanne (FR)

(73) Assignee: Lacme, La Garenne Colombes (FR)

( * ) Notice: Subject to any disclaimer, the term of this patent is extended or adjusted under 35 U.S.C. 154(b) by 0 days.

(21) Appl. No.: 09/459,899

(22) Filed: Dec. 14, 1999

(30) Foreign Application Priority Data

Dec. 23, 1998 (FR) ..... 98 16305

(51) Int. Cl.[7] ..... H05C 1/04
(52) U.S. Cl. ..... 307/108; 361/232; 256/10
(58) Field of Search ..... 307/106, 108; 361/232; 256/10; 375/239

(56) References Cited

U.S. PATENT DOCUMENTS

| | | | | | |
|---|---|---|---|---|---|
| 3,900,770 | A | * | 8/1975 | Kaufman | 361/232 |
| 3,988,594 | A | * | 10/1976 | Low et al. | 307/132 R |
| 4,160,214 | A | * | 7/1979 | Colin et al. | 327/181 |
| 4,394,583 | A | * | 7/1983 | Standing | 307/108 |
| 4,396,879 | A | * | 8/1983 | Weinreich et al. | 256/10 |
| 4,725,825 | A | * | 2/1988 | McKean | 256/10 |
| 4,859,868 | A | * | 8/1989 | McKissack | 256/10 |
| 5,596,281 | A | * | 1/1997 | Eriksson | 324/678 |
| 5,651,025 | A | * | 7/1997 | May | 256/10 |
| 5,742,104 | A | * | 4/1998 | Eriksson et al. | 256/10 |
| 5,767,592 | A | * | 6/1998 | Boys et al. | 256/10 |
| 5,771,147 | A | * | 6/1998 | Eriksson et al. | 256/10 |
| 6,020,658 | A | * | 2/2000 | Woodhead et al. | 256/10 |
| 6,065,427 | A | * | 5/2000 | Peinetti | 119/52.3 |
| 6,084,505 | A | * | 7/2000 | Walley | 307/109 |

FOREIGN PATENT DOCUMENTS

| | | | | | |
|---|---|---|---|---|---|
| DE | 3727787 | A1 | * | 3/1989 | H05C/1/04 |
| DE | 3904993 | A1 | * | 8/1990 | H05C/1/04 |
| DE | 4104386 | A1 | * | 9/1991 | H03K/3/53 |
| DE | 19962618 | A1 | * | 7/2000 | H05C/1/04 |
| EP | 0036089 | A1 | * | 2/1981 | H05C/1/04 |
| EP | 0 251 820 | | | 1/1988 | |
| EP | 0390227 | A2 | * | 8/1988 | H05C/1/04 |
| EP | 0 454 543 | | | 10/1991 | |
| WO | WO 01/84892 | A2 | * | 11/2001 | H05C/1/04 |

* cited by examiner

*Primary Examiner*—Brian Sircus
*Assistant Examiner*—Roberto J. Rios
(74) *Attorney, Agent, or Firm*—Young & Thompson

(57) ABSTRACT

Several storage condensers (1, 1', . . . 1") are mounted in parallel. Several thyristors (2, 2', . . . 2") are each mounted in parallel with one condenser (1, 1', . . . 1") to ensure the individual discharge of each condenser without modification of the condition of the other condensers. The discharge of the condensers (1, 1', . . . 1") is controlled in sequence so as to deliver to the secondary of the transformer a complex pulse comprised by a series of elemental pulses, each elemental pulse corresponding to the individual discharge of one condenser.

7 Claims, 2 Drawing Sheets

CLOSURE ELECTRIFIER WITH A LOW MASS TRANSFORMER

FIELD OF THE INVENTION

The invention relates to a closure electrifier with a low mass transformer.

BACKGROUND OF THE INVENTION

Electrical closures are adapted to protect spaces, and particularly fields, against intrusion or the escape of an animal for example. These closures comprise essentially a conductive element, such as a wire, cable or strip, delimiting the space to be protected, and an electrifier adapted to send through the conductive element, high voltage pulses of controlled energy. To ensure insulation between the conductive element of the closure and the electrical supply source of the electrifier, this latter comprises a transformer which also ensures the increase of voltage of the output pulses to the required level.

The state of the art is shown in FIG. 1, in which a condenser 1 is charged with a voltage $V_c$, and periodically discharged into the primary 4 of a transformer (4-5-6) under the control of a thyristor 2. The impulse applied to the conductive element of the closure is available between the terminals 23 and 24 of the secondary 5 of the transformer (4-5-6), and has an amplitude and a duration. The amplitude corresponds to the voltage at the output terminals 23, 24 of the transformer. The electrical energy of the pulse is proportional on the one hand to its amplitude, on the other hand to its duration.

The electrical energy stored in the condenser 1 is transmitted to the conductive element of the closure by means of the transformer (4-5-6). This energy transmission takes place with a satisfactory output so long as the magnetic circuit 6 is not saturated. Beyond saturation, the losses in the magnetic circuit 6 increase very rapidly. The current in the primary 4 of the transformer reaches high values, which gives rise to large losses from the Joule effect. Any increase of the energy stored in the condenser 1 thus corresponds only to a marginal increase of the energy transmitted to the conductive element of the closure.

If the pulse energy applied to the conductive element of the closure must be substantially increased, it is then necessary to use an unsaturated magnetic circuit, which is to say a magnetic circuit of a higher cross-section and hence of larger dimensions and greater mass, and higher cost.

SUMMARY OF THE INVENTION

An object of the present invention is to provide a closure electrifier which permits transmitting high energy pulses with a low mass transformer.

The invention has for its object a closure electrifier with a transformer having a low mass magnetic circuit, comprising a transformer with insulation of the conductive element of the closure connected to the secondary of the transformer, a condenser for storing electrical energy and a thyristor adapted to be rendered conductive by a control signal applied to its trigger, to ensure the discharge of the surge condenser through the primary of the transformer and the delivery of a pulse to the secondary, characterized in that it comprises several storage condensers mounted in parallel, several thyristors each mounted in parallel on one condenser to ensure the individual discharge of each condenser without modification of the condition of the other condensers, and in that the discharge of the condensers is controlled sequentially so as to deliver to the secondary of the transformer a complex pulse comprised by a series of elemental pulses, each elemental pulse corresponding to the individual discharge of one condenser, this individual discharge being ordered only when the magnetic circuit has returned to its initial condition.

According to other characteristics:

the primary of the transformer is mounted between the point common to the storage condensers and the point common to the thyristors;

each one of the storage condensers is mounted in series with a diode, said diodes having a common point;

the common point of the diodes is the cathode;

the common point of the diodes is the anode;

each circuit branch comprising a condenser and a diode in series is mounted between the point common to the condensers and the point common to the diodes;

the discharge of the condensers is controlled sequentially by an electronic circuit controlled by software.

BRIEF DESCRIPTION OF THE DRAWINGS

Other characteristics will become apparent from the description which follows, given with reference to the accompanying drawings, in which.

DETAILED DESCRIPTION OF PREFERRED EMBODIMENTS

Figure 1:
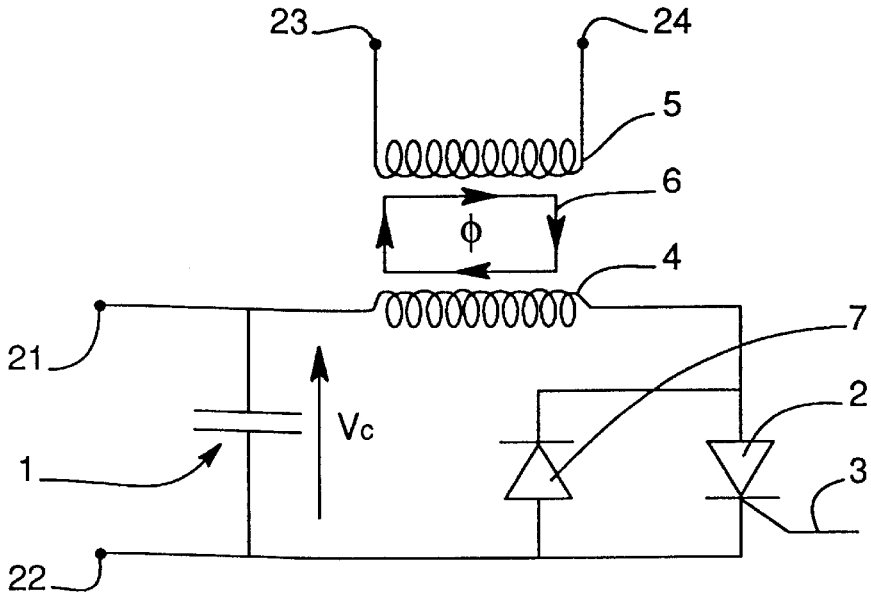
FIG. 1 is a simplified fragmentary circuit diagram of an electrifier according to the prior art.

In FIG. 1, the known electrifier is simplified by an electrical energy storage condenser 1, a transformer 4-5-6 for the insulation and elevation of voltage and a thyristor 2 with a trigger 3. A diode 7 is mounted reversely on the thyristor 2, in conventional manner. Between the terminals 23, 24 of the secondary 5 of the transformer is connected the conductive element (not shown) of the enclosure.

The condenser 1 is charged with a voltage $V_c$ of several hundreds of volts, by a charge circuit known per se, not shown, and applied to the input terminals 21, 23. With a period of the order of one second, a control signal is applied to the trigger 3 of the thyristor 2 which becomes conductive. The condenser 1 then discharges into the primary winding 4 of the transformer. The magnetic circuit 6 ensures coupling of the primary 4 and the secondary 5. To the terminals of the secondary 5 is delivered a high voltage pulse, of several millions of volts, for example. Upon the discharge of the condenser 1, magnetic induction in the magnetic circuit 6 increases and then decreases.

Figure 2:
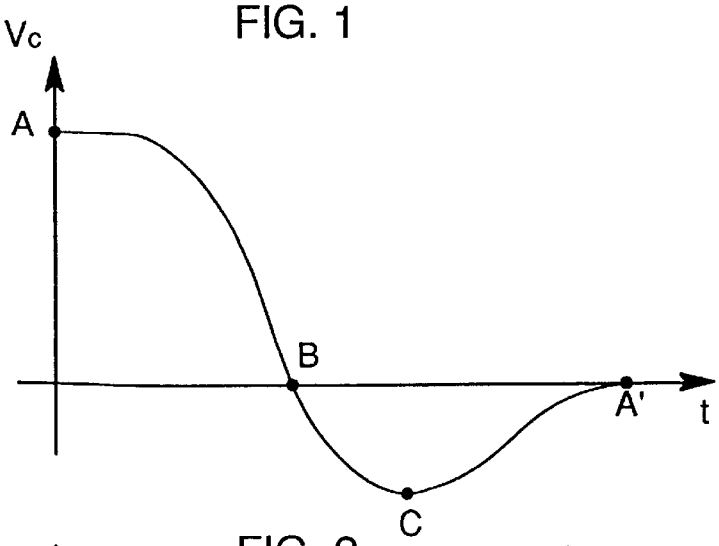
FIG. 2 is a curve giving the general appearance, as a function of time, of the voltage at the terminals of an energy storage condenser during dispatch of a pulse.

FIG. 2 gives the curve of voltage at the terminals of the condenser 1 in the course of a discharge. At point A, the condenser has been charged to its maximum voltage and the thyristor 2 is rendered conductive. The voltage at the terminals of the condenser 1 decreases, passes through zero at point B, then becomes negative because of the self-inductance of the primary 4 of the transformer. From point C, the voltage at the terminals of the condenser 1 increases to reach the value zero at point A'.

Between points C and A', the current passing through the primary 4 changes in direction and passes through the diode 7.

Figure 3:
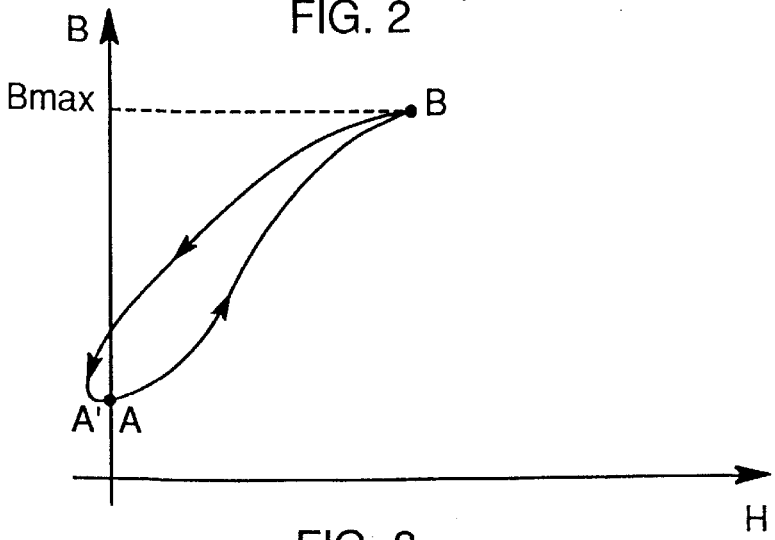
FIG. 3 is a curve giving the general appearance of the development of magnetic induction as a function of the magnetic field in the magnetic circuit of the transformer of FIG. 1.

FIG. 3 gives the curve of inductance as a function of the magnetic field in the magnetic circuit 6 in the course of the same discharge. The laws of magnetism require that the radiation in the course of time of the magnetic induction in the magnetic circuit 6 is proportional to the voltage applied to the primary 4 of the transformer, the proportionality constant intervening principally in the section of the magnetic circuit 6.

Between the points A and B of FIG. 2, the voltage at the terminals of the condenser 1 is positive, hence the magnetic induction increases and reaches its maximum $B_{max}$ at point B in FIG. 3. Between the points B, C and A' of FIG. 2, the voltage at the terminals of the condenser 1 is negative, hence the magnetic induction decreases.

The exact shape of the voltage at the terminals of the condenser 1 as a function of time, like inductance as a function of the magnetic field, of course depends on the values of the elements as well as the nature of the material constituting the magnetic circuit 6. When a steady state is reached, there is achieved at each impulse a curve identical to the preceding one and the magnetic circuit is at the end of the pulse in a condition identical to that which it had at the beginning. In the diagram of FIG. 3, the points A and A' thus overly each other and represent the initial condition of the magnetic circuit.

Figure 4:
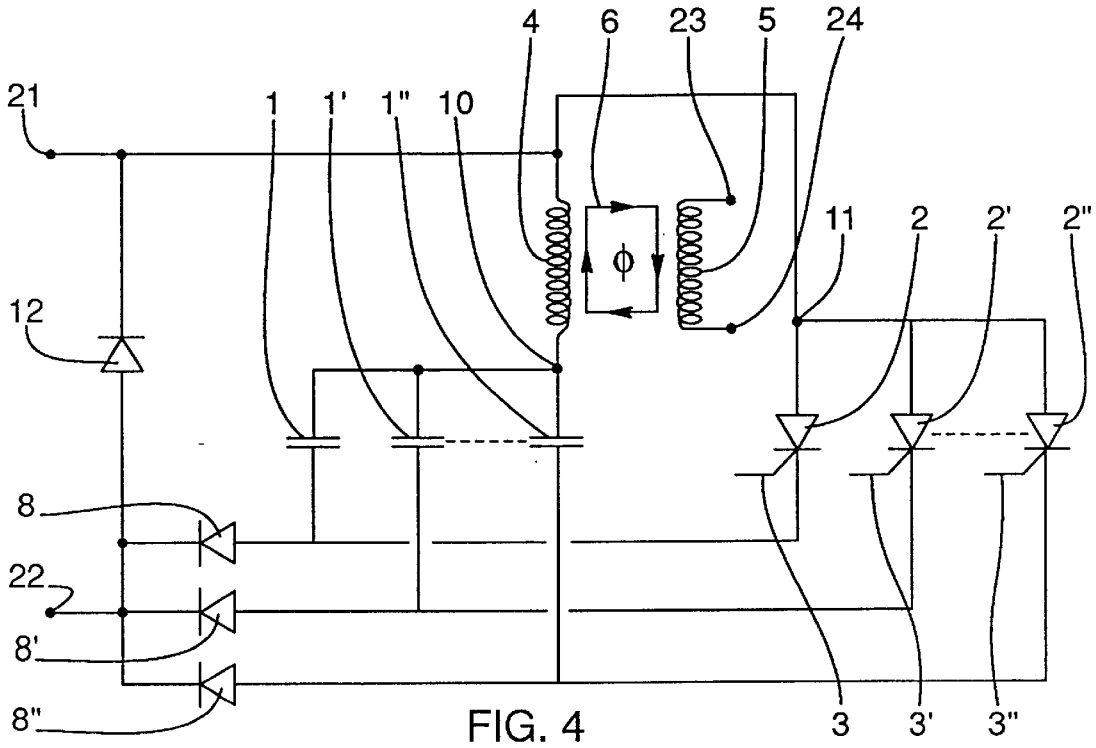
FIG. 4 is a partial simplified circuit diagram of a first embodiment of an electrifier according to the invention.

In FIG. 4, the input terminals 21 and 22 are connected to the known charge circuit (not shown), as in FIG. 1. Between the terminals 21 and 22 is connected a diode 12 which plays the same role as diode 7 in FIG. 1. The primary 4 of the transformer is mounted between the input terminal 21 and a common point 10. Several storage condensers 1, 1' . . . 1", are mounted in parallel between the common point 10 and the input terminal 22, each of these condensers being mounted in series with a diode, respectively 8, 8', . . . 8", to avoid them being discharged into each other. The common point at the cathode of the diodes 8, 8', . . . 8" is connected on the one hand to the anode of the diode 12 and on the other hand to the input terminal 22. In parallel to the primary 4 and to each of the energy storage condensers 1, 1', . . . 1", is connected to a thyristor, respectively 2, 2', . . . 2", each with its trigger 3, 3', . . . 3".

Between the common point 10 of the condensers 1, 1', . . . 1" and the common point 11 of the anodes of the thyristors 2, 2' . . . 2", is mounted the primary 4 of the transformer for insulating and raising voltage, which is coupled, by means of the magnetic circuit 6, to the secondary 5 whose output terminals 23, 24 supply the conductive element of the closure.

Figure 5:
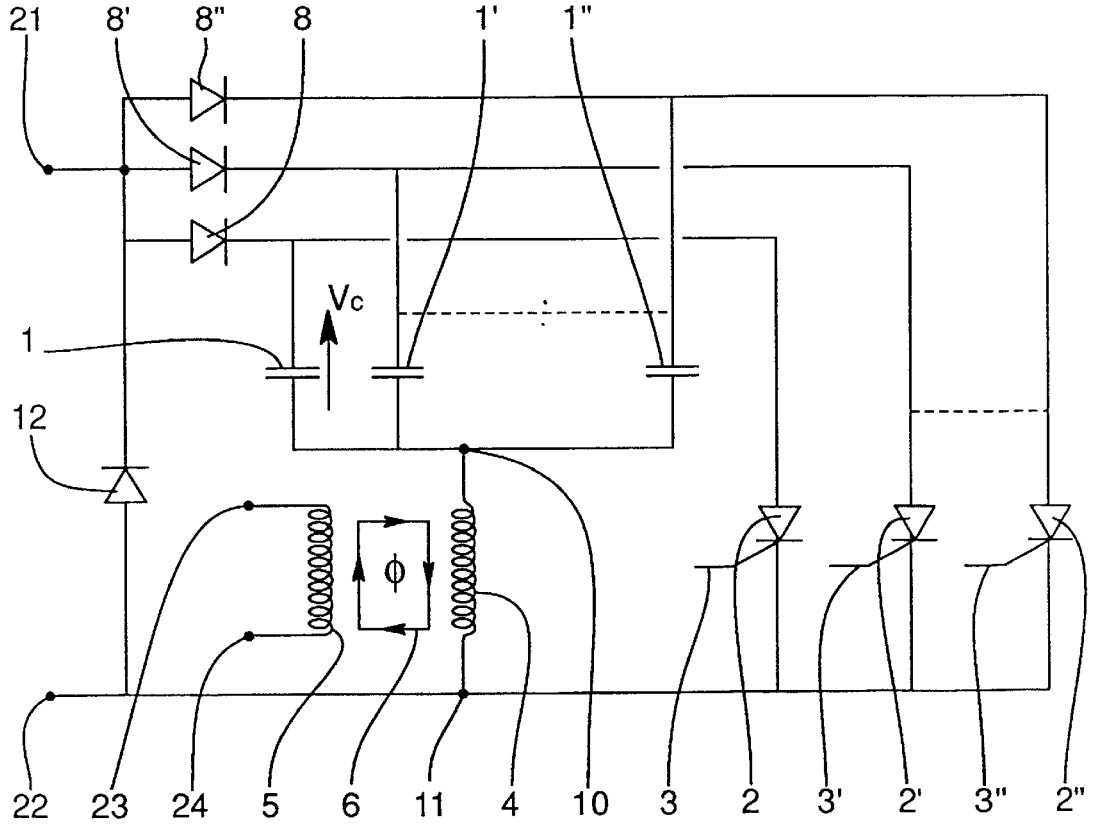
FIG. 5 is a fragmentary simplified electrical diagram of a second embodiment of an electrifier according to the invention.

In FIG. 5, the same components as in FIG. 4 have the same reference numerals, and the arrangements of the diodes 8, 8' . . . 8" is reversed relative to the storage condensers 1, 1', . . . 1". The common point to the anodes of the diodes 8, 8', . . . 8", is connected to the input terminal 21 and to the cathode of diode 12. The primary 4 of the transformer is mounted between the point 10 common to the condensers and the point 11 common to the cathodes of the thyristors 2, 2', . . . 2".

In the two embodiments of FIGS. 4 and 5, each circuit branch comprising a condenser and a diode in series, is mounted between the point 10 common to the condensers and the point common to the diodes.

In the two embodiments of FIGS. 4 and 5, the operation of the electrifier is the same. The condensers 1, 1', . . . 1" are charged with the same voltage $V_C$ of several hundreds of volts by a known means (not shown). The diodes 8, 8', . . . 8" ensure that the condensers 1, 1', . . . 1" are charged at the same voltage and that each can be discharged individually without modifying the condition of the other condensers.

A control pulse is applied by the trigger 3 of the thyristor 2 which becomes conductive. The condenser 1 is discharged through the primary 4 of the transformer and a first pulse appears at the secondary terminals 5. The condensers 1' and 1" remain charged because of the presence of the diodes 8' and 8" which prevents them from discharging into the condenser 1. At the end of this first pulse, when the magnetic circuit 6 has returned to its initial condition at the point 8' of FIG. 3, a control pulse is applied by the trigger 3' of the thyristor 2' which again becomes conductive. The condenser 1' is discharged through the primary 4 of the transformer and a second pulse appear at the terminals of the secondary 5. The process continues until the last thyristor 2' becomes conductive, discharging the last condenser 1".

There thus appears at the secondary a complex pulse comprised by a series of several successive individual pulses. If all the condensers 1, 1', . . . 1" loaded with the same voltage are equal, each individual pulse carries to the secondary 6 of the transformer the same energy. If the condensers do not all have the same capacity, the energies imparted to the secondary are different. In the two cases, the energy of the complex impulse is the sum of the energies of the individual pulses. The order of magnitude of the duration of an individual pulse is comprised between several hundreds of microseconds and 1 to 2 milliseconds. The physiological phenomena, causing the painful sensation induced in an animal when it is in contact with the closure wire, have response times of several tens to several hundreds of milliseconds. As a result, although the total duration of the complex pulse remains less than about 20 ms, the unpleasant sensation for the animal is identical to that when it receives a single pulse whose energy will be equal to the sum of the energies of the individual pulses.

Thus, with a transformer whose magnetic circuit is of low mass, adapted to transmit an energy E under good output conditions, the electrifier according to the invention, designed with several storage condensers of individual energy at most equal to E, adapted to be discharged sequentially, permits transmitting to the conductive element of the closure the equivalent of one pulse whose energy is the sum of the individual energies stored by the condenser (the number of condensers being at least equal to 2). If this same energy were to be transmitted by an electrifier according to the prior art, the transformer to be used would be of much greater dimensions and hence much greater mass and of a much higher cost.

By way of example, according to the prior art shown in FIG. 1, a storage condenser of 25$\mu$, and a transformer weighing 1 Kg, permit delivering to the secondary, at a voltage of 6 to 7 KV, a pulse corresponding to an energy of about 4 Joules. This pulse has a duration of about 0.4 ms.

According to the invention, two condensers of 12 $\mu$F each are used in the primary, and they permit delivering to the secondary each one a pulse of a voltage of 6 to 7 KV, corresponding to an energy of about 2 Joules. Each pulse has a duration of 0.2 ms.

The two pulses are separated by an interval of about 5 ms, necessary so that the magnetic circuit of the transformer will be returned to its initial condition after discharge of the first condenser, and sufficient such that the anode which touches the closure receives only one overall pulse of 4 Joules. In such a case, the transformer weighs only 0.3 Kg, which represents the saving in weight, storage space and appreciable cost relative to the prior art.

To ensure the sequence of the successive discharges of the condensers, it is necessary to control the periodicity of the control signals of the triggers of the thyristors. This periodicity can be ensured by a control circuit which can be either an analog circuit, or an electronic circuit controlled by software.

According to the invention, as soon as the magnetic circuit 6 returns to its initial condition after a discharge of a storage condenser, it is possible to proceed with the discharge of another storage condenser, and so on. This is in contrast to an electrifier of the prior art (FIG. 1), in which it is necessary to wait until the condenser is recharged in order to be able to proceed with a new discharge.

What is claimed is:

1. Closure electrifier with the transformer having a low mass magnetic circuit, comprising a transformer isolating the conductive element of the closure connected to the secondary of the transformer, a storage condenser for electrical energy and a thyristor adapted to be rendered conductive by a control signal applied to its trigger, to ensure the discharge of the storage condenser through the primary of the transformer and the delivery of a pulse to the secondary, characterized in that it comprises several storage condensers (1, 1', . . . 1") mounted in parallel, several thyristors (2, 2', . . . 2") each mounted in parallel to a condenser (1, 1', . . . 1") to ensure the individual discharge of each condenser without modification of the condition of the other condensers, and in that the discharge of the condensers (1, 1', . . . 1") is controlled in sequence so as to deliver to the secondary of the transformer a complex pulse comprised by a series of elemental pulses, each elemental pulse corresponding to the individual discharge of a condenser (1, 1', . . . 1"), this individual discharge being controlled only when the magnetic circuit has returned to its initial condition.

2. Electrifier according to claim 1, characterized in that the primary (4) of the transformer is mounted between the point (10) common to the storage condensers (1, 1' . . . 1") and the point (11) common to the thyristors (2, 2', . . . 2").

3. Electrifier according to claim 2, characterized in that each of the storage condensers (1, 1', . . . 1") is mounted in series with a diode (8, 8', . . . 8"), said diodes (8, 8', . . . 8") having a common point.

4. Electrifier according to claim 3, characterized in that the common point of the diodes (8, 8', . . . 8") is the cathode.

5. Electrifier according to claim 3, characterized in that the common point of the diodes (8, 8', . . . 8") is the anode.

6. Electrifier according to claim 3, characterized in that each circuit branch comprising a condenser (1, 1', . . . 1") and a diode (8, 8', . . . 8") in series is mounted between the point (10) common to the condensers and the point common to the diodes.

7. Electrifier according to claim 1, characterized in that the discharge of the condensers (1, 1', . . . 1") is controlled in sequence by an electronic circuit controlled by software.

* * * * *